US005189744A

United States Patent [19]

Roberts

[11] Patent Number: 5,189,744

[45] Date of Patent: Mar. 2, 1993

[54] SHEET OR BLANKET CONSTRUCTION WITH EXPANDABLE POCKET FOR END FITTING ON MATTRESS

[76] Inventor: Donna D. Roberts, 2231 Hartford Ave., Fullerton, Calif. 92631

[21] Appl. No.: 790,455

[22] Filed: Nov. 12, 1991

[51] Int. Cl.[5] ..... A47G 9/04; A47G 9/02

[52] U.S. Cl. ..... 5/497

[58] Field of Search ..... 5/497, 485, 495, 496, 5/498–502

[56] References Cited

U.S. PATENT DOCUMENTS

| | | | |
|---|---|---|---|
| 2,695,414 | 11/1954 | Ford et al. | 5/497 |
| 2,963,715 | 12/1960 | Young | 5/497 |
| 3,020,566 | 2/1962 | Anderson et al. | 5/497 |
| 3,654,646 | 4/1972 | McMahon, Jr. | 5/497 |
| 3,962,739 | 6/1976 | Crocket | 5/497 |
| 4,035,854 | 7/1977 | Pardee | 5/497 |

*Primary Examiner*—Alexander Grosz
*Attorney, Agent, or Firm*—Willie Krawitz

[57] ABSTRACT

A sheet or blanket construction for end fitting onto a mattress is provided with an expandable end pocket that extends along the width of the sheet and into which the mattress is fitted. An elastic material is incorporated into the edges of the end pocket, and along with integrally formed gathers, provides the necessary expandable characteristics of the pocket. This enables the sheet to be fitted onto commercially sized mattresses, and to tightly enclose the end of the mattress, without slipping out of position. Also, if desired, the sheet edges may be trimmed to a suitable width and then seamed. When users, particularly children, lie under the sheet it will not become dislodged, while providing adequate foot room in the pocket for the user.

2 Claims, 1 Drawing Sheet

SHEET OR BLANKET CONSTRUCTION WITH EXPANDABLE POCKET FOR END FITTING ON MATTRESS

BACKGROUND OF THE INVENTION

This invention relates to a new and improved sheet or blanket construction having an expandable end portion which enables it to be end fitted onto commercially sized mattresses, and which may be tightly fitted without slipping out of position.

Usually, these types of prior art sheets or blankets tend to have a complicated construction, or have a two-piece design, or employ tie-down strings. Typical patents of prior art sheets include: U.S. Pat. Nos. 2,679,056; 2,695,414; 3,258,789; 3,654,646; 3,824,640; 3,906,559; 4,316,299; and, 4,656,682.

It would be desireable to provide a new and improved single sized sheet or blanket which can be securely end-fitted around commercially sized mattresses such as regular, full (i.e., double), queen and king, and which can function both as a cover or as a bottom sheet.

THE INVENTION

According to the invention, there is provided a new and improved construction of a single-piece sheet, blanket or the like having an expandable end which can be enlarged to tightly end fit commercial mattress sizes, for use as a support or as a cover sheet.

The single-piece sheet of this invention includes an expandable end pocket extending across the entire width of the sheet to enable a tight fit over a mattress end, and covering a wide range of mattress sizes. The end pocket is formed by means of elastic elements sewn along the edges of the pocket and by forming the sheet into gathers along the pocket edges.

Consequently when the expandable end pocket is fitted over the end of a mattress, the elastic elements and the expandable gathers are initially expanded so as to fit the pocket over the mattress end. When the pocket is then released, the elastic elements will contract about the mattress end to produce a tight fit, and thereby secure the sheet in place on the mattress during use. The gathers will assume a somewhat expanded form, without becoming excessively tensioned, and this reduces wear caused by a tensioning of the sheet in the vicinity of the end pocket.

DESCRIPTION OF THE PREFERRED EMBODIMENTS

Figure 1:
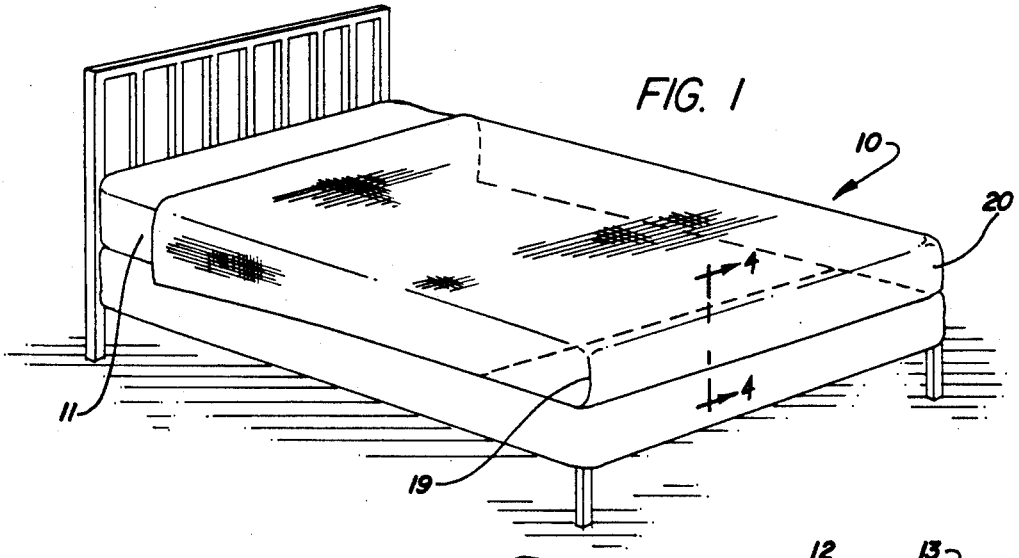
FIG. 1 is an external, perspective view of the sheet of this invention installed on a mattress.
Figure 2:
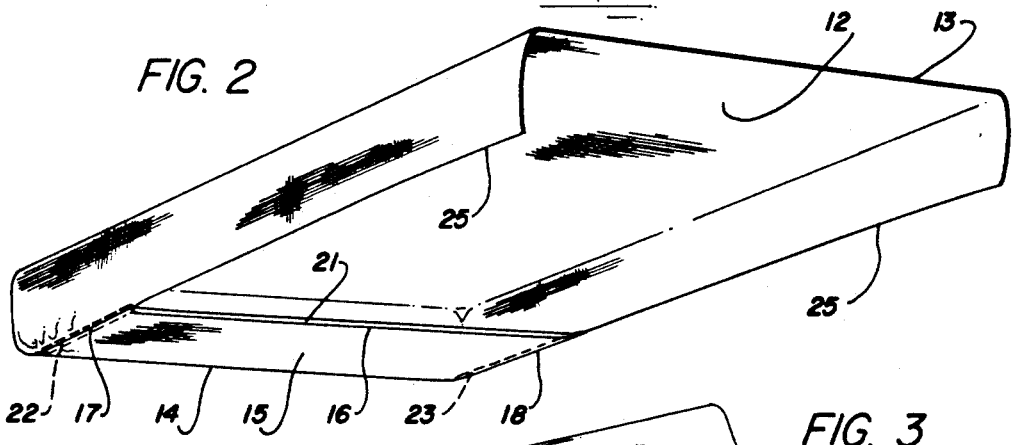
FIG. 2 is an external, perspective view showing the sheet in a stretched-out configuration.
Figure 3:
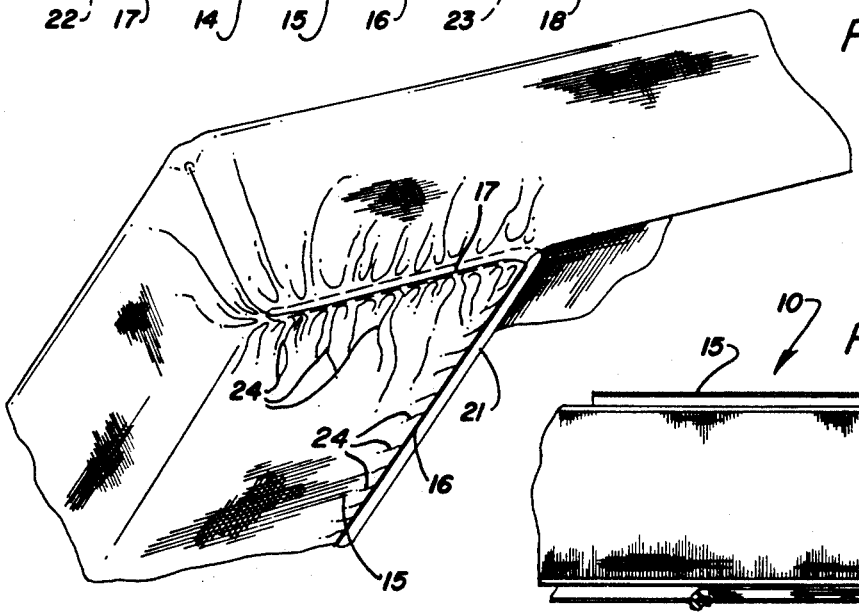
FIG. 3 is an external, perspective view showing the expandable end portion in a stretched configuration; and, FIG. 4 is a sectional side elevation view taken along lines 4—4 of FIG. 1.
Figure 4:
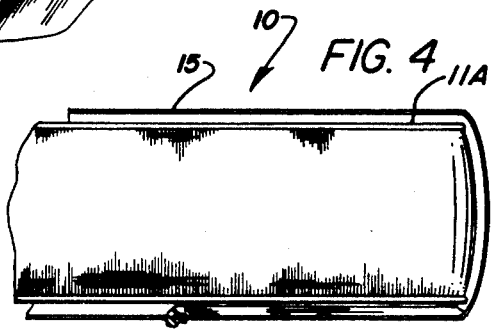

The sheet 10, blanket or the like of this invention is shown in FIGS. 1–4 mounted on a mattress 11 at one end 11*a*. The sheet comprises a flat portion 12 on which a user rests, or the sheet or blanket can instead be used as a light cover. The sheet defines a free end 13, a mattress fitting end 14, and a sewn pocket 15 which is formed across the width of the mattress fitting end 14. The pocket 15 is defined along a horizontal seam line 16, end seam lines 17, 18 and reinforced seam lines 19, 20 on each end of the pocket. An elasticized element or insert 21 is incorporated into the horizontal seam line 16; if desired, the end seam can be integrally formed or separated from the insert. Similarly, elasticized elements 22 and 23 are incorporated into end seams 17 and 18.

In order to enable the sheet, blanket or the like to expand along the sewn pocket 15, when it is inserted over the end of a mattress, a series of expandable gathers 24 of the sheet are integrally formed along the pocket when it is first 12 sewn, and these gathers function to expand along with the elastic inserts. Hence, the combination of the gathers 24 and the elasticized inserts 21, 22 and 23 enable the pocket 15 to be expanded around the mattress end 11*a* when it is fitted over the mattress. If desired, to avoid excessive trailing of the sides, the sheet may be edge trimmed and seamed 25, and this will also save material. Preferably, the pocket 15 is at least about 8" deep to ensure an adequate securement of the sheet on the mattress, but not more than 12", to prevent restriction to the user's feet.

It will be appreciated that the sheet or blanket item construction of this invention enables the sheet to be fitted over commercially sized mattresses. Also, since both the elasticized insert and gathers are capable of expansion, the user is enabled to fit their feet comfortably within the pocket, without dislodging the end of the sheet from the mattress.

I claim:

1. A sheet, blanket or the like for and fitting around a mattress having corner and upper and lower surface areas, comprising:

a) an expandable pocket formed integrally of the sheet and defining an open seam line horizontally of the sheet and overlying an end portion of the mattress along its lower surface area, and two spaced, generally parallel closed seam lines at each end of the pocket, generally perpendicular to said open seam line, said pocket adapted for fitting around the mattress corners;

b) an elastic element incorporated into the open seam line, and an elastic element incorporated into closed seam lines; and, c) a plurality of gathers formed by the sheet along at least the open seam line, whereby:

i. the elastic elements and the gathers are expandable, thereby enabling the positioning of the expandable pocket onto mattress ends of various sizes;

ii. upon positioning of the expandable pocket onto a mattress, the elastic elements contract, thereby securing the end pocket onto an end of the mattress and enabling the user to lie either on top of, or under the sheet, blanket or the like, and in the latter instance, the user's feet are comfortably secured within the expandable pocket, and without dislodging the end pocket from the mattress;

iii. the said sheet, blanket or the like defining sides which are edge trimmed to about the width of the mattress, the said sides extending from the said open seam line at each end thereof; and, iv. the sheet, blanket or the like is secured to the mattress as a single thickness, without any auxiliary attachments thereto.

2. The sheet, blanket or the like, according to claim 1, in which the expandable pocket is about 8"–12" in depth.

* * * * *